US007954816B2

(12) United States Patent
Freitag et al.

(10) Patent No.: US 7,954,816 B2
(45) Date of Patent: Jun. 7, 2011

(54) VOUCHER STACKING APPARATUS

(75) Inventors: Paul Freitag, Steinheim (DE); Ulrich Nottelmann, Bad Driburg (DE); Wilfried Schnelle, Paderborn (DE)

(73) Assignee: Wincor Nixdorf International GmbH (DE)

( * ) Notice: Subject to any disclaimer, the term of this patent is extended or adjusted under 35 U.S.C. 154(b) by 0 days.

(21) Appl. No.: 12/607,735

(22) Filed: Oct. 28, 2009

(65) Prior Publication Data

US 2010/0117296 A1 May 13, 2010

Related U.S. Application Data

(63) Continuation of application No. PCT/EP2009/060612, filed on Aug. 17, 2009.

(30) Foreign Application Priority Data

Aug. 22, 2008 (DE) ..... 10 2008 039 357

(51) Int. Cl.
*B65H 5/02* (2006.01)

(52) U.S. Cl. ..... 271/277; 271/275; 271/198

(58) Field of Classification Search ..... 271/275, 271/276, 315, 306, 307, 198, 27
See application file for complete search history.

(56) References Cited

U.S. PATENT DOCUMENTS

| | | | | |
|---|---|---|---|---|
| 1,462,923 | A | 7/1923 | Stevens | |
| 3,174,749 | A | 3/1965 | Childs | |
| 4,647,032 | A | 3/1987 | Oba | |
| 5,156,393 | A | 10/1992 | Erkisson | |
| 7,487,968 | B2 * | 2/2009 | Landwehr | 271/312 |
| 7,641,195 | B2 * | 1/2010 | Suzuki | 271/307 |
| 2008/0061498 | A1 | 3/2008 | Suzuki | |
| 2010/0072697 | A1 * | 3/2010 | Sokolowski | 271/277 |

FOREIGN PATENT DOCUMENTS

| | | | |
|---|---|---|---|
| DE | 101 47 134 | A1 | 4/2003 |
| EP | 0 962 413 | A2 | 4/1999 |
| GB | 2 324 521 | A | 4/1997 |
| WO | WO 03/026994 | A1 | 4/2003 |

* cited by examiner

*Primary Examiner* — Kaitlin S Joerger
(74) *Attorney, Agent, or Firm* — Harness, Dickey & Pierce, P.L.C.

(57) ABSTRACT

The invention relates to an apparatus for stacking vouchers that has at least one circumferential stacking belt (82). The stacking belt (82) has a circumferential belt body and at least one tongue pair (86*a* to 86*c*) provided outwardly on the belt body. The tongue pair (86*a* to 86*c*) has a transport tongue (90*a* to 90*c*) and a pressure tongue (88*a* to 88*c*). The pressure tongue (88*a* to 88*c*) and the transport tongue (90*a* to 90*c*) are configured and disposed such that the pressure tongue (88*a* to 88*c*) applies contact pressure to the transport tongue (90*a* to 90*c*) in the direction of the belt body at least in a circumferential area of the stacking belt (82).

13 Claims, 6 Drawing Sheets

VOUCHER STACKING APPARATUS

BACKGROUND OF THE INVENTION

1. Technical Field

The invention relates to a voucher stacking apparatus having at least one circumferential stacking belt that has a circumferential belt body and a transport tongue for accommodating at least one part of the voucher.

2. Discussion

A plurality of stacking systems for vouchers is known in which stacking belts are used. A system for stacking banknotes in banknote cassettes with the aid of a stacker and singulator module is known, for example, from the previously unpublished German patent application DE 10 2008 018 935.9. However, with known stacking belts only a relatively low contact pressure can be applied to the banknote located in the transport tongue, resulting in the banknote possibly slipping at least partially from the transport tongue. As a result, an uneven stack can be created or a paper jam can occur, caused by the banknote that was partially pulled from the transport tongue.

SUMMARY OF THE INVENTION

An object of the invention is to propose an apparatus for stacking vouchers that enables notes to be transported reliably and in a simple manner.

Contact pressure suitable for transporting the voucher is generated specifically by the tongue pair provided on the body of the circumferential belt with at least one transport tongue and at least one pressure tongue, said pressure being specifically dependent on the type and shape of the pressure tongue. Furthermore, a space is created between the belt body and a stack already consisting of at least one voucher as a result of the tongues lying partially on top of each other in the direction the stacking belt circulates and the shape of the tongues, so that a feed area, or feed slot, is created for feeding the voucher located in the transport tongue to the at least one voucher already forming a stack. In addition, the stacking belt can be used to transport the stack created further by pressing the side of the stack facing the belt against the belt, in particular in an area where no tongue pair is present on the belt. Stacking belts have the essential advantage that a relatively small space is needed for a stacking apparatus using stacking belts. In contrast, the stacking wheels that can be used as an alternative for stacking require a relatively large space.

In an advantageous aspect of the invention, the transport tongue is lifted from the circumferential belt, and thus opened, by a voucher introduced into the transport tongue. In this open state of the transport tongue, the pressure tongue applies contact pressure to the transport tongue in the direction of the belt so that the voucher is pressed against the body of the circumferential belt by the transport tongue. As the result of this pressure, at least the adhesive friction between transport tongue and voucher is increased. In areas in which the stacking belt with the tongues on the body of the belt is radially deflected, the pressure tongue does not apply any contact pressure to the transport tongue. Rather, the pressure tongue can be lifted from the transport tongue and/or the transport tongue can be lifted from the voucher. As a result, it is possible to feed the voucher easily into the transport tongue as well as to extract the voucher easily from the transport tongue when the pressure tongue does not apply any contact pressure to the transport tongue, and/or when the transport tongue is lifted from the voucher.

In another aspect of the invention, at least two jockey rollers are provided to deflect the stacking belt radially. The stacking belt is guided over the at least two jockey rollers. As a result, it is a simple matter to effectuate lifting of at least one of the tongues, that is to say the pressure tongue is lifted from the transport tongue, or the transport tongue is lifted from the voucher or from the body of the belt. It is advantageous in this respect to connect at least one of the jockey rollers, secured against rotation, to a drive shaft for the purpose of driving the stacking belt. It is further advantageous to dispose several stacking belts adjacent one another across the width of the narrowest banknote that is to be stacked. Specifically, three stacking belts can be provided adjacent one another. It is advantageous in this regard if the stacking belts are disposed parallel to one another and are spaced equidistant from one another. The stacking belt, or the stacking belts respectively, preferably have three tongue pairs, wherein the tongue pairs are disposed at the same angular distance on the outer surface of the belt body. It is preferable if the inside of the stacking belt has serrations similar to the serrations of a cog belt. The slippage between a jockey roller configured as a drive roller and the stacking belt can thereby be reduced. Further, the jockey roller can have complementary serrations on its outer surface so that a positive connection exists between cog belt and jockey roller or drive roller.

The stacking belt is preferably produced from polyurethane or a polyurethane compound, or contains polyurethane. Specifically, a reinforcement can additionally be provided in the stacking belt, specifically a mesh or a cord, specifically a textile, fiberglass or metal mesh or cord. It is particularly advantageous if the stacking belt contains para-phenylene diisocyanate.

It is advantageous to produce several stacking belts in one piece as a continuous tube, together with the tongue pairs disposed externally on the belt body. In this way, several stacking belts with almost identical properties can be produced after the tube is manufactured if the stacking belts are cut from said tube and are of the same width. Specifically, the stacking belts produced in this fashion have the same diameter. It is particularly advantageous if the retaining and pressure tongue and the transport tongue are respectively attached at different locations to the body of the stacking belt so that the area for attaching the retaining and pressure tongue to the belt body and the area for attaching the transport tongue to the belt body are spaced apart from each other in the direction in which the stacking belt circulates. It is advantageous in this regard to locate the retaining and pressure tongue downstream from the transport tongue when viewed in the direction of circulation.

It is further advantageous if at least the retaining and pressure tongue in the tongue pair has a curved shape projecting concavely from the surface of the stacking belt. The forward end in the direction of circulation of the retaining and pressure tongue is solidly attached to the stacking belt, or to the body of the stacking belt respectively, perpendicular to the direction of circulation of the stacking belt. The back end of the pressure tongue, the opposite end in the direction of circulation, rests preferably under preload on the transport tongue when the tongue pair is located on a straight side of a stacking belt system as the result of the circulation of the stacking belt. A straight side is the area between two points for deflecting the stacking belt between which a section of the stacking belt is tensioned.

The vouchers can specifically be banknotes, where the apparatus for stacking the banknotes is located preferably in an automated teller machine or in an automated safe. With the aid of the stacking apparatus, the vouchers are preferably stacked into a bundle in order to dispense several vouchers.

It is particularly advantageous if the apparatus has at least one stop that halts the movement of the voucher occasioned by the stacking belts while the stacking belt continues to run. The voucher is withdrawn from the transport tongue. The retaining and pressure tongue of the tongue pair on the stacking belt is shaped such that, while the voucher is being transported with the aid of the stacking belt, a stack formed from the vouchers already deposited is kept at a distance by the retaining and pressure tongue. Through the contact of the retaining and pressure tongue with the top side of the stack, the retaining and pressure tongue is additionally pressed against the transport tongue, and a space is created between the voucher located in the transport tongue and the voucher located on the face of the stack facing the stacking belt. The feed of the voucher located in the transport tongue is not hampered as a result, and contact pressure on the voucher is increased.

BRIEF DESCRIPTION OF THE DRAWINGS

Additional features and advantages of the invention will become apparent from the following description, which, in conjunction with the appended Figures, explains the invention in more detail using an embodiment.

DESCRIPTION OF THE PREFERRED EMBODIMENTS

Figure 1:
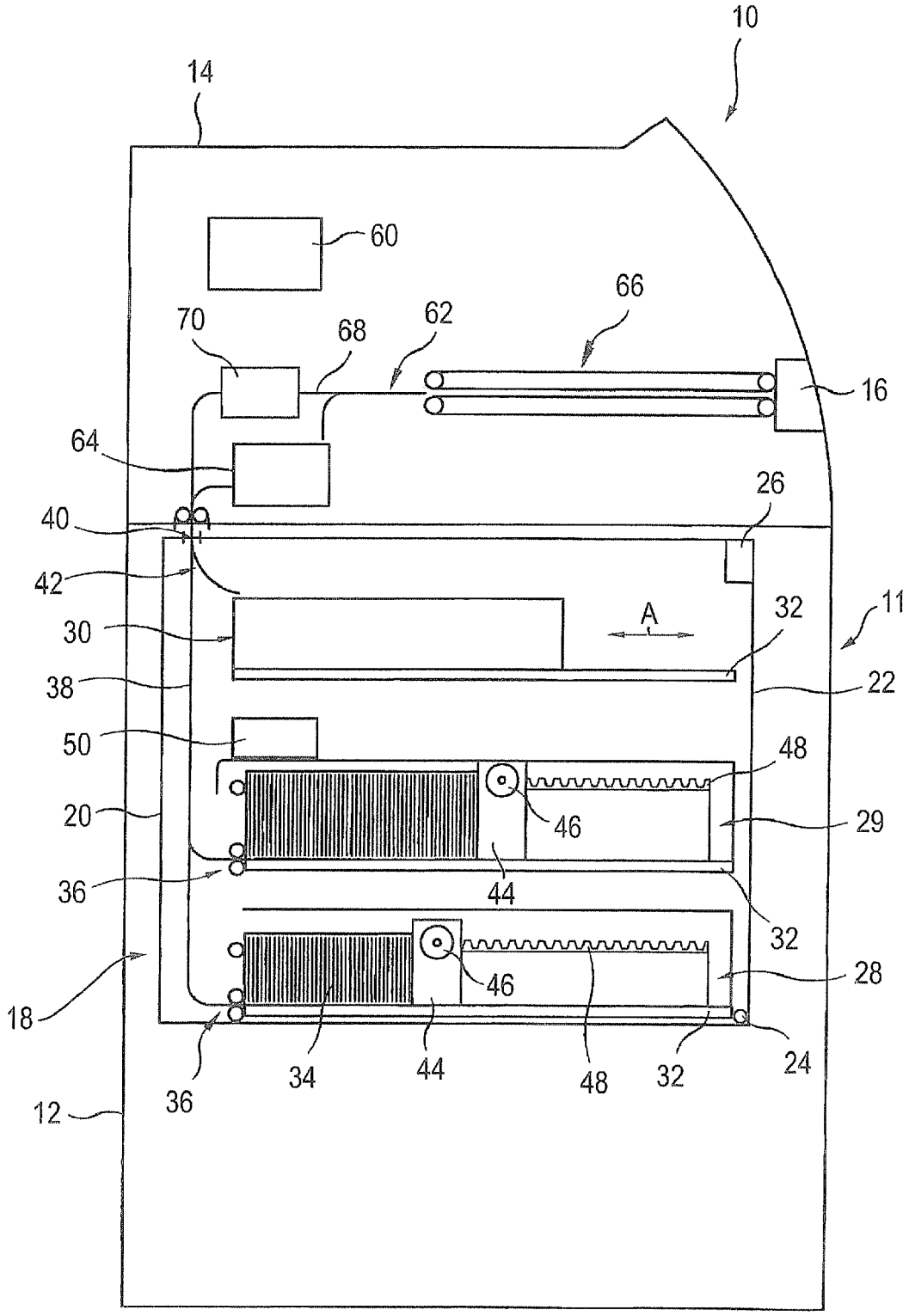
FIG. 1 shows a schematic vertical section through an automated teller machine.

A vertical section through an automated teller machine 10 is shown in FIG. 1 with a housing generally identified with the numeral 11. The housing encompasses a cabinet-like lower part 12 and a housing upper part 14 set upon said lower part 12.

The functional units required for processing and for depositing and dispensing banknotes as well as for operating the automated teller machine 10 are located in the housing upper part 14. Said units encompass a display unit (not shown) and an input unit (also not shown) in addition to a dispensing drawer 16.

A safe 18 is located in the housing lower part 12 that has a box-shaped safe container 20 and a safe door 22 connected to said container. The safe door 22 is attached to the safe container 20 by a hinge 24, and can be pivoted into an open position and into a closed position and secured by a lock 26.

In the embodiment shown, a total of three banknote cassettes 28, 29, 30 are located in the safe 18, where cassettes 28 and 29 are dispensing cassettes and cassette 30 is a collection cassette. Of course, the number and configuration of cassettes 28, 29 30 can vary in other embodiments of the invention. Collection cassette 30 is also designated as a retraction cassette and serves to receive banknotes that were prepared for the customer for a dispensing transaction and have not been removed from the dispensing drawer 16 within a preset time period. Cassettes 28 to 30 can be moved into and out of said drawer along the double arrow A on guide rails 32 provided for this purpose through the door opening into the safe 18.

Dispensing cassettes 28, 29 serve respectively to receive a stack of banknotes 34, the forward end of which, when dispensing cassette 28, 29 is completely inserted, abuts a draw-off and singulator device 36, with the aid of which individual banknotes can be withdrawn from the stack of banknotes 34. When collection cassette 30 is fully inserted into safe 18, the feed slot of collection cassette 30 abuts a banknote feed device with the aid of which individual banknotes are transported into the collection cassette 30 and deposited in the storage area of the collection cassette 30 as a stack. The draw-off and singulator devices 36 and the banknote feed unit of the collection cassette 30 are connected respectively to a vertical transport system 38 on the side facing away from the banknote stacks 34 that transports the banknotes at a transfer point through a pass-through slot 40 in the safe container 20 and further into the housing upper part 14, or in the opposite direction. To do this, the transport direction of the vertical transport system 38 is reversible, so that banknotes that are transported by way of the pass-through slot 40 into the safe 18 can be transported via a diverter 42 into the collection cassette 30.

A pressure tray 44 is provided in the banknote receiving area of each cassette 28, 29, 30 that pushes the banknote stack 34 towards the draw-off and singulator device 36 and enlarges the stacking area for the banknote stack in the collection cassette 30 before, while or after banknotes are brought in. The traversing of the pressure tray 44 is performed by an electric motor 46 located on the tray 44 by which pinion gears can be driven that mesh with a rack 48 provided on the lateral bounding walls of the banknote receiving area.

In addition, a control unit 50 is located in the safe 18 that controls the draw-off and singulator devices 36, the banknote feed unit for the collection cassette 30, the vertical transport system 38, and the diverter 42. The control unit 50 is connected to a second control unit 60 in the housing upper part 14 via a plug connector (not shown).

In addition, further transport routes 62 are provided in the housing upper part 14 that comprise transport elements (not shown) and connect the pass-through slot 40 to the dispensing drawer 16. A stacking unit 64 is located in one branch of the transport route 62 in accordance with the embodiment of the invention that will be explained in greater detail hereinafter in conjunction with FIG. 2. The stacking unit 64 stacks the individual banknotes, which were removed by means of the draw-off and singulator devices 36 from the withdrawal units 28, 29 for the dispensing transaction, into a bundle. This bundle is then prepared in the dispensing drawer 16 for a customer for removal. A section of the transport route 62 bordering the output drawer 16 is formed by a belt drive 66 with oppositely disposed transport belts. The banknote stacks prepared by the stacking unit 64 can be transported between the transport belts to the output drawer 16 and, if required, away from the output drawer 16.

The transport route 62 can further encompass an additional transport path 68 via which banknotes that have been prepared for the customer in the dispensing drawer 16, but not removed by him, are transported back again after a preset time and deposited in the collection cassette 30. A singulator device 70 is integrated in the transport path 68 that singulates the banknotes of a returned bundle again. The banknotes of the returned bundle are then transported through the pass-through slot 40 and, with the aid of the vertical transport system 38 and the diverter 42, further into the collection cassette 30. In the same way, stacks of banknotes deposited by the customer can be singulated again with the aid of the singulating device 70 and taken to the collection cassettes 30 for deposit in said cassettes in an orderly form as stacks. This can be accomplished either by a device, not shown, for feeding banknotes or by a feed and stacking function of the draw-off and singulating devices 36 by way of said device. Automated banking machines in which banknotes deposited are taken to the cassettes provided for dispensing are also designated as automated cash recycling machines.

Figure 2:
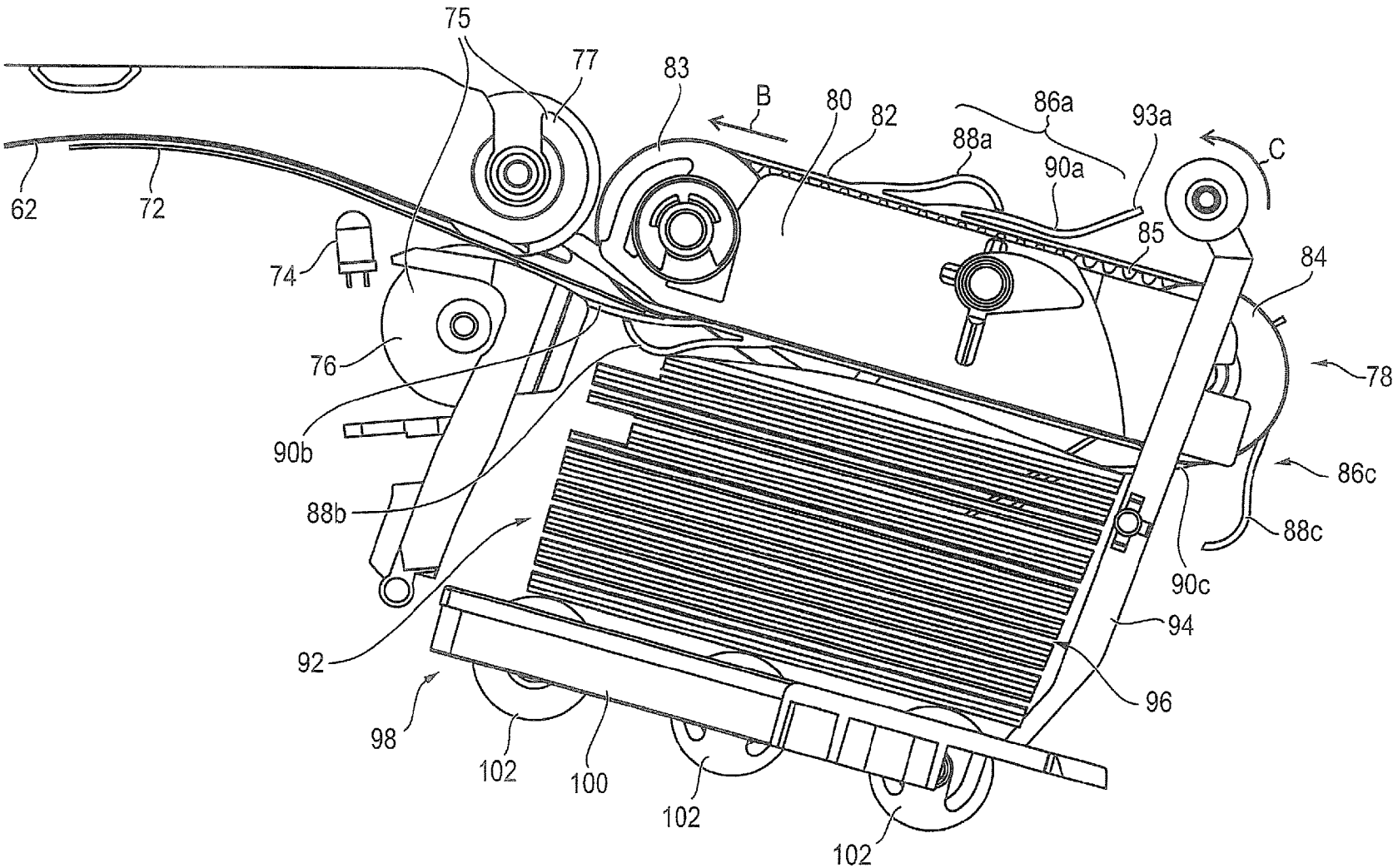
FIG. 2 shows a side elevation of a stacking unit of the automated teller machine from FIG. 1.

The side view of stacking unit 64 is shown in FIG. 2. Elements with the same structure or the same function are identified with the same reference numeral. A banknote 72 transported over transport route 62 to stacking unit 64 to be deposited in a stack is transported past a detection unit 74 for detecting the leading edge of banknote 72 brought to it and transported with the aid of a transport roller pair 75 with drive roller 76 and pressure roller 77 towards a stacking belt system 78.

Figure 3:
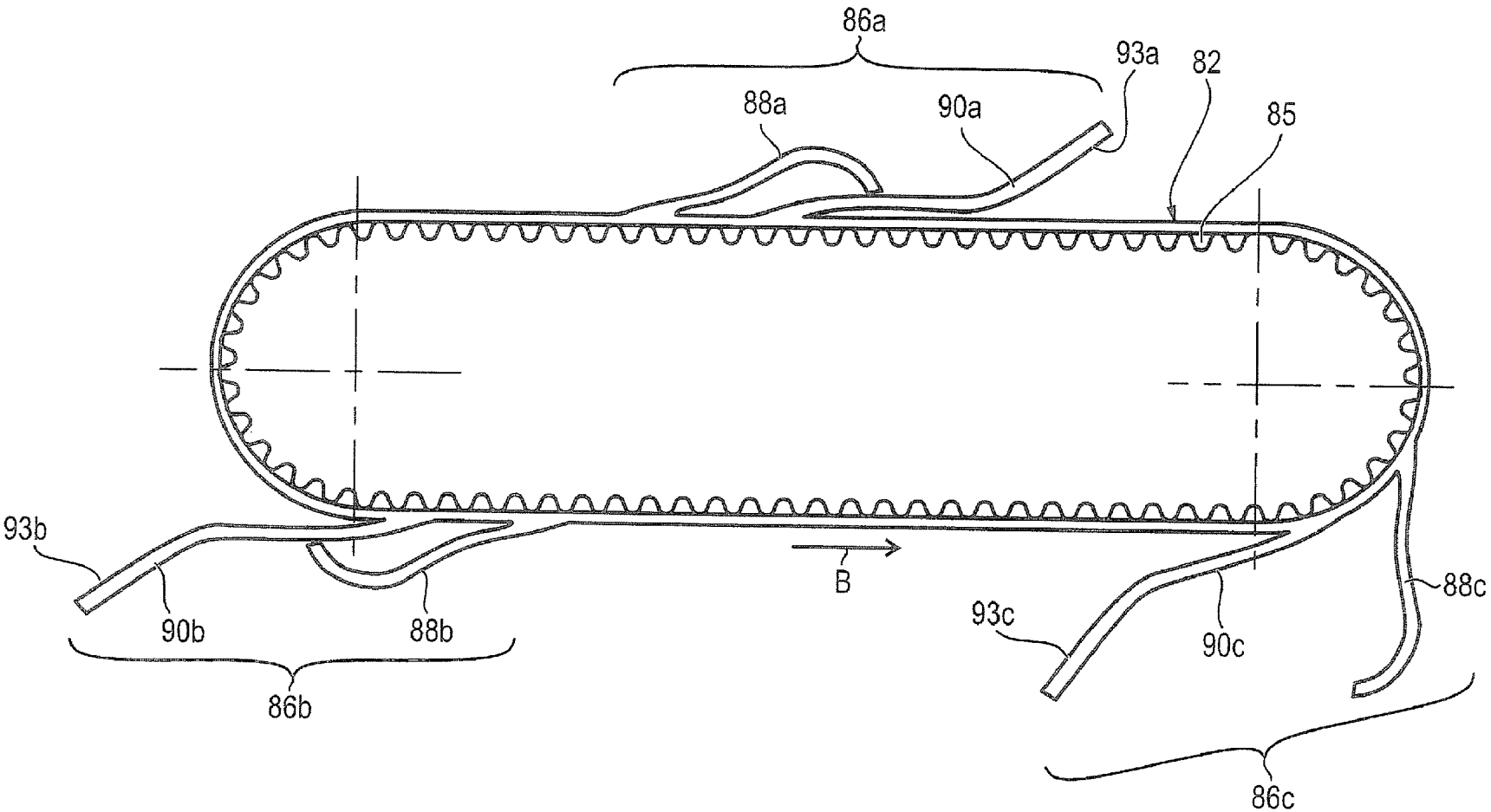
FIG. 3 shows a side view of a stacking belt in the installed position for use in the stacking unit from FIG. 2.
Figure 4:
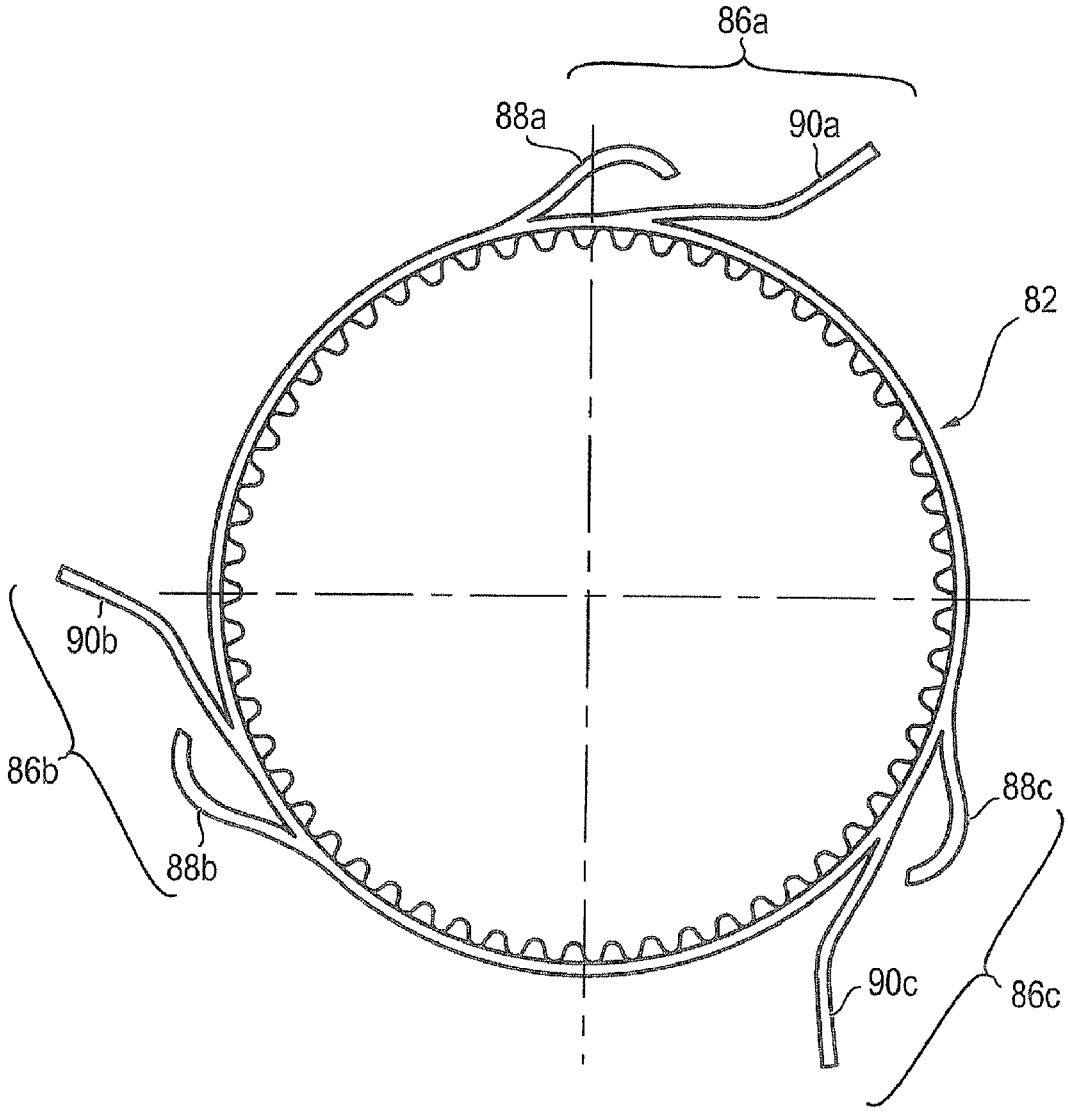
FIG. 4 shows the stacking belt from FIG. 3 in delivery mode.
Figure 5:
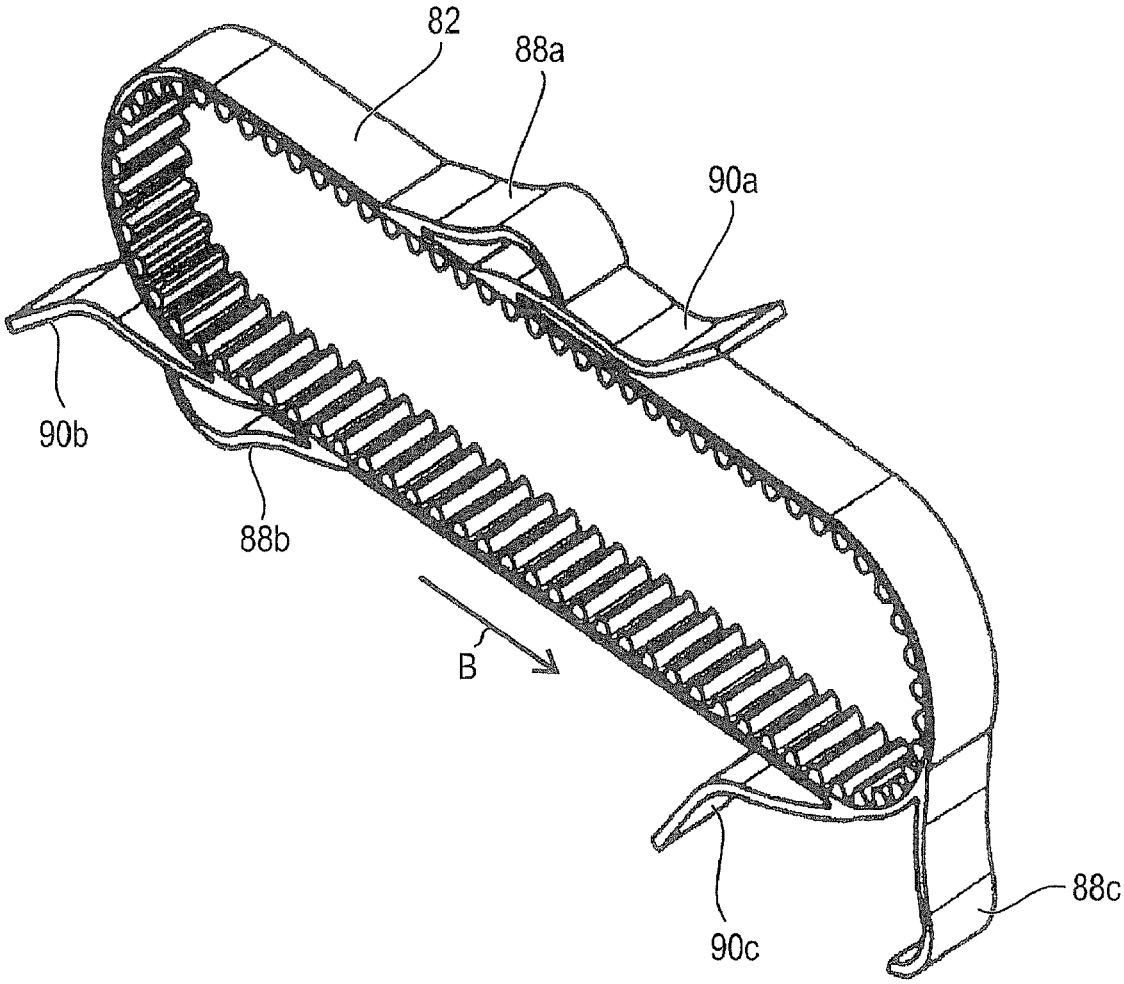
FIG. 5 shows a three-dimensional view of the stacking belt from FIGS. 3 and 4.

Stacking belt system 78 encompasses two jockey rollers 83, 84, in the style of a pulley, over which a circumferential stacking belt 82 is carried that is shown in detail in FIGS. 3 to 5. One of the pulleys is connected to a drive shaft, secured against rotation, so that stacking belt 82 can be driven by way of the drive shaft and pulley 83, 84. The inside of stacking belt 82 has serrations similar to a cog belt that engage complementary serrations on pulley 83, 84 connected to the drive shaft.

Further, stacking belt 82 encompasses three tongue pairs 86*a*, 86*b*, 86*c* disposed at the same angular distance on the surface of said belt. Of course, depending on the design of stacking unit 64, stacking belts 82 with more or fewer tongue pairs 86*a* to 86*c* can be used. Stacking belt 82 and tongue pairs 86*a* to 86*c* are cast of PDDI polyester polyurethane in one piece as a continuous tube. In this way, seams of any kind are avoided, creating a very smooth, homogenous texture and preventing banknotes from becoming stuck. Each tongue pair 86*a* to 86*c* comprises a front retaining and pressure tongue 88*a* to 88*c*, indicated by arrow B viewed in the direction that stacking belt 82 circulates, and a transport tongue 90*a* to 90*c* located at a specified distance behind retaining and pressure tongue 88*a* to 88*c*. Retaining and pressure tongue 88*a* to 88*c* has a curved shape projecting concavely from the outside surface of the stacking belt. The front end of retaining and pressure tongue 88*a* to 88*c*, viewed in transport direction B, is solidly attached to stacking belt 82 perpendicular to the direction of circulation of said belt. The opposite end of retaining and pressure tongue 88*a* to 88*c*, located at the back in the direction of transport B, rests preferably under preload on transport tongue 90*a* to 92*c*, while tongue pair 86*a* to 88*c* is located on one of the straight sides of the stacking belt system 78 as stacking belt 82 is circulating. As a result, retaining and pressure tongue 88*a* to 88*c* then presses transport tongue 90*a* to 90*c* at least towards the outer surface of stacking belt 82 when transport tongue 90*a* to 90*c* is pushed away from the outer surface of stacking belt 82. Transport tongue 90*a* to 90*c*, on the other hand, has an almost parallel course to the outer surface of stacking belt 82 in a banknote receiving and retaining area. An infeed section 93*a* to 93*c* of transport tongue 90*a* to 90*c* adjoins the banknote receiving and holding area of transport tongue 90*a* to 90*c* and stands out at an acute angle from the outer surface of stacking belt 82 while tongue pair 86*a* is located, as stacking belt 82 circulates, on one of the straight sides of stacking belt system 78.

When banknote 72 reaches stacking belt system 78, a transport tongue 90*b* of the stacking belt 82 is disposed in a basic stacking position to receive banknote 72 taken to stacking unit 64. In this basic stacking position, the transition point from transport tongue 90*b* to stacking belt 82 is at, or immediately after, the transition from the semicircular curvature of the outer surface of stacking belt 82 at jockey roller 83 facing transport roller pair 75 to the lower straight side of stacking belt 82, and thus, together with the outer surface of stacking belt 82, forms an open feed slot in which a forward area of banknote 72 can be received.

After banknote 72 has been transported into transport tongue 90*b* and has reached the forward edge of the banknote receiving and retaining area of transport tongue 90*b*, stacking belt 82 has been accelerated with the aid of a drive unit, not shown, via one of the pulleys 83, 84 to the transport speed of banknote 72, wherein the feed slot is closed by the movement of stacking belt 82, and banknote 72 is firmly wedged in transport tongue 90*b*. This wedging of banknote 72 in transport tongue 90*b* is assisted by the contact pressure applied by pressure tongue 88*b* to transport tongue 90*b*. In this firmly wedged condition, banknote 72 is transported fully into a position in which its front, or rear, side is located in front of the surface of a stack of banknotes already stacked in a stacking drawer 92. If banknote 72 is the first banknote 72 to be transported into a collecting drawer 92 in which banknotes 72 are stacked, banknote 72 is disposed in a position opposite the floor of the collecting drawer.

Thus, banknote 72 is transported over the entire length of the collecting drawer 92 until it is halted in its movement at a stop 94 projecting laterally next to stacking belt 82. The longitudinal axis of stop 94 runs orthogonally to stacking belt system 78 through the center of curvature of the semi-circle of stacking belt system 78 facing away from transport route 62 and preferably orthogonally to the lower straight side of stacking belt 82.

During the transport of banknote 72 with the aid of stacking belt 82, note stack 96 composed of the banknotes already deposited is pressed down by retaining and pressure tongue 88*b*. Tangling of banknote 72 with the banknotes of note stack 96 and any banknote jam resulting therefrom is thereby avoided, even with poor note quality and increasing height of note stack 96 during transport by stacking belt 82. Moreover, through its contact with the upper side of note stack 96, retaining and pressure tongue 88*b* is additionally pressed against transport tongue 90*b*.

As a result, the contact pressure applied by transport flap 90*b* to banknote 72 and the restraining force effected thereby are further increased. At the end of collecting drawer 92, as the result of the curvature of stacking belt system 78, both the downforce, or the contact pressure, of retaining and pressure tongue 88*c* on transport tongue 90*c* as well as the adhesive friction of banknote 72 with the underside and topside of transport tongue 90*c* is released so that banknote 72 can be stripped without damage by stop 94 at a further circulating movement of stacking belt 92. Banknotes 72 are thus stacked with their forward edge at a lateral delimiting element 94 of collecting drawer 92.

Collecting drawer 92 is bounded in a downward direction by a support unit 98 lying opposite stacking belt system 78 and inclined slightly towards delimiting element 94 that comprises a delimiting frame 100 not further shown and three rollers 102.

A side elevation of a stacking belt 82 in the installation position in stacking unit 64 from FIG. 2 is shown in FIG. 3, where only stacking belt 82 and the axes of rotation of pulleys 83, 84 are shown, without further elements of stacking unit 64.

Stacking belt 82 from FIG. 3 is shown in FIG. 4 in the delivery mode.

A three-dimensional view of stacking belt 82 from FIGS. 3 and 4 is shown in FIG. 5 in the installation position, without further elements of stacking unit 64.

Figure 6:
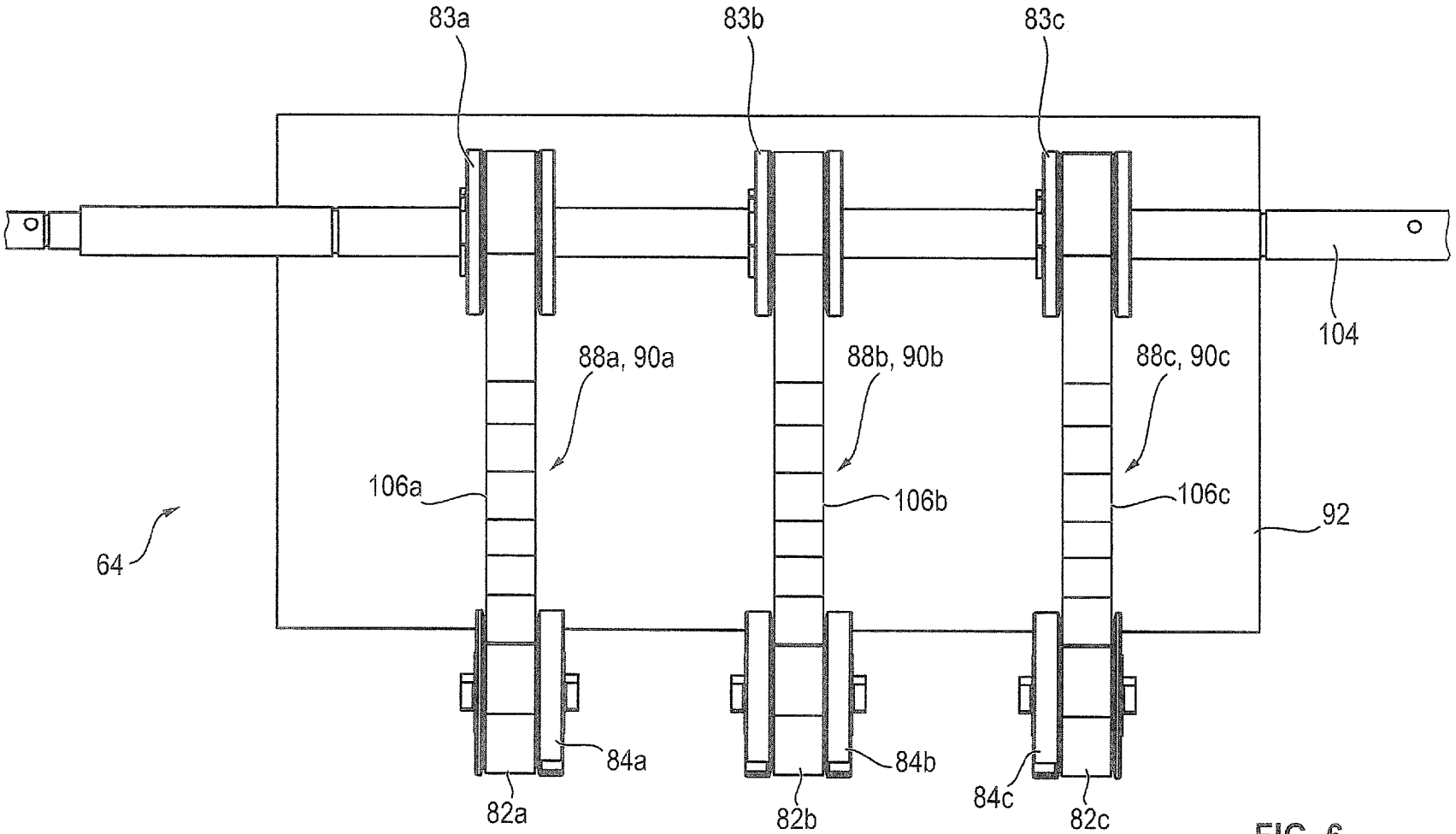
FIG. 6 shows a plan view of the stacking unit from FIG. 2 with three stacking belts.

A plan view of a stacking unit 64 from FIG. 2 with three stacking belts disposed next to each other 82*a* to 82*c* is show in FIG. 6. In the embodiment shown, two adjacent stacking belts 82*a* to 82*c* are equidistant from each other. The maximum distance between the outer edges 106*a*, 106*c* of outer stacking belts 82*a*, 82*c* is advantageously as large as, preferably smaller than, the length of the long sides of the smallest banknote 72 to be stacked.

Stacking belts 83*a* to 83*c* are connected to a drive shaft 104, secured against rotation. Drive shaft 104 is driven, for example, by a electric motor, not shown.

What is claimed:

1. Apparatus for stacking vouchers comprising at least one circumferential stacking belt that has a circumferential belt body and at least one tongue pair provided outwardly on the belt body with a transport tongue and with a pressure tongue, whereby the pressure tongue and the transport tongue are configured and disposed in such a way that the pressure tongue applies contact pressure to the transport tongue in the direction of the belt body at least in a circumferential area of the stacking belt.

2. Apparatus of claim 1, wherein at least a voucher introduced into the transport tongue generates a space between transport tongue and the belt body so that the pressure tongue presses the transport tongue against the voucher with contact pressure.

3. Apparatus of claim 1, wherein at least two jockey rollers are provided over which the stacking belt is guided.

4. Apparatus of claim 1, wherein the stacking belt has at least two tongue pairs and wherein the tongue pairs of the stacking belt are disposed at identical angular distances on the surface of the stacking belt.

5. Apparatus of claim 1, wherein the inside of the stacking belt has serrations similar to the serrations of a cog belt.

6. Apparatus of claim 1, wherein the stacking belt and the tongue pair are produced from polyester polyurethane.

7. Apparatus of claim 1, wherein several stacking belts and the tongue pairs are produced in one piece as a continuous tube.

8. Apparatus of claim 1, wherein the retaining and pressure tongue and the transport tongue of the tongue pair are disposed at a distance from each other in the direction in which the stacking belt circulates.

9. Apparatus of claim 1, wherein the retaining and pressure tongue of the tongue pair of the stacking belt has a curved shape projecting concavely from the surface of the stacking belt, where the front end of the retaining and pressure tongue in the direction of circulation is solidly attached to the stacking belt perpendicular to the direction of circulation of said belt, and the opposite end at the back in the direction of circulation rests preferably under preload on the transport tongue while the tongue pair is located on one of the straight sides of the one stacking belt as the stacking belt circulates.

10. Apparatus of claim 1, wherein the transport tongue of the tongue pair of the stacking belt runs almost parallel to the stacking belt in a receiving and holding area, and an infeed section of the transport tongue projects at an acute angle from the surface of the stacking belt while the tongue pair is located on one of the straight sides of the stacking belt as the stacking belt circulates.

11. Apparatus of claim 1, wherein the apparatus has a collecting drawer to collect the vouchers.

12. Apparatus of claim 1, wherein the apparatus has at least one stop that stops the movement of the voucher occasioned by the stacking belt, while the stacking belt continues to circulate.

13. Apparatus of claim 1, wherein the retaining and pressure tongue of the tongue pair of the stacking belt is shaped such that, while the voucher is being transported with the aid of the stacking belt, a stack formed of the vouchers already deposited is kept at a distance by the retaining and pressure tongue, and the retaining and pressure tongue is pressed against the transport tongue by contact with the upper side of the stack.

* * * * *